United States Patent [19]

Puretic

[11] Patent Number: 4,884,924

[45] Date of Patent: Dec. 5, 1989

[54] FISH HOLD CONSTRUCTION

[76] Inventor: Mario J. Puretic, P.O. Box 58070, Tierra Verde, Fla. 33715

[21] Appl. No.: 901,627

[22] Filed: Aug. 29, 1986

Related U.S. Application Data

[63] Continuation of Ser. No. 711,730, Mar. 14, 1985, abandoned, which is a continuation-in-part of Ser. No. 325,980, Nov. 30, 1981, abandoned, which is a continuation-in-part of Ser. No. 153,040, May 27, 1980, abandoned.

[51] Int. Cl.[4] ..... B65G 53/44

[52] U.S. Cl. ..... 406/82; 406/119; 406/130; 406/132; 414/143.2; 114/255; 114/73; 114/74 R

[58] Field of Search ..... 406/38, 39, 82, 106, 406/108, 119, 120, 130, 132, 122, 127; 405/81, 82; 414/140, 144; 43/6.5; 114/255, 73, 74 R; 222/561

[56] References Cited

U.S. PATENT DOCUMENTS

| | | | |
|---|---|---|---|
| 3,261,176 | 7/1966 | Puretic | 114/255 X |
| 3,261,316 | 7/1966 | Puretic | 414/140 X |
| 4,103,792 | 8/1978 | Puretic | 414/786 |
| 4,280,640 | 7/1981 | Daloisio | 222/561 |
| 4,442,786 | 2/1984 | Conners | 114/255 |

FOREIGN PATENT DOCUMENTS

| | | | |
|---|---|---|---|
| 353304 | 5/1961 | Switzerland | 406/132 |

*Primary Examiner*—Sherman D. Basinger
*Assistant Examiner*—Paul E. Salmon
*Attorney, Agent, or Firm*—Fulwider, Patton, Rieber, Lee & Utecht

[57] ABSTRACT

A fish hold construction for a fishing vessel, wherein the vessel is provided with a longitudinally extending water flume fish alley. Fish move with the help of gravity and water or brine into such fish alley from a plurality of fish storage holds. Water or brine is continuously recirculated through the fish alley to urge the fish along such alley into a fish elevating conveyor for removal from the vessel. A 'tween deck located in vertical alignment with, and above, the fish alley houses pipes, pumps and refrigeration components.

10 Claims, 4 Drawing Sheets

FISH HOLD CONSTRUCTION

BACKGROUND OF THE INVENTION

This application is a continuation of my now-abandoned continuation-in-part application Ser. No. 711,730 filed Mar. 14, 1985 which was a continuation-in-part of my now abandoned Ser. No. 325,980 filed Nov. 30, 1981 which was a continuation-in-part of my application Ser. No. 153,040 filed May 27, 1980.

The present invention relates generally to the art of fishing and more particularly to a novel fish hold construction that facilitates unloading fish from a fishing boat.

Although fishing is one of the oldest arts, comparatively little has been done over the years to change the apparatus and methods that have been utilized in unloading fish from the holds of a fishing boat. Generally, fish are unloaded by means of a large bucket that is suspended from a hoist. Prior to the unloading operation the brine is removed from the holds. Thereafter, a crew of laborers descend into the main fish hold and handload the bucket with fish. The loaded bucket is then raised through the hatch to the deck or to a dock. After the main fish hold has been emptied of fish, hatches connecting the main fish hold with adjoining auxiliary holds are removed. Fish from the auxiliary holds are then manually moved into the main hold for removal by the bucket. This unloading operation involves several disadvantages. Thus, it requires a comparatively large number of workmen. The conditions within the fish holds are extremely uncomfortable. The unloading operation requires many hours, with a resultant expensive tie-up time of the boat. Moreover, the workmen bruise and thereby damage the fish by contact with their feet.

In my U.S. Pat. No. Re. 28,186, there is disclosed a system for removing fish from the hold of a fishing boat utilizing a power-operated fish-impelling device having an enclosure arranged in a loop and including a power-driven plurality of blades. Water is admitted to the lower portion of the fish-filled hold and the salinity of such water is adjusted to cause the fish to float near the surface of the water. The fish then enter the fish-impelling device and are engaged by the moving blades thereof so as to be continuously propelled upwardly from the hold.

In my U.S. Pat. No. 3,261,316, there is shown a fishing vessel provided with a fish unloading system utilizing fish storage compartments provided with downwardly inclined gravity walls, wherein the fish slide along said walls onto a conveyor belt for removal from the fishing vessel. Conveyor belts are expensive to construct and maintain. Also, it is difficult to maintain fish-handling conveyor belts sanitary, inasmuch as the cleaning of such belts, rollers and associated parts is extremely difficult. Transfer of fish onto and off of the conveyor belts tends to bruise and damage such fish.

In my U.S. Pat. No. 4,103,792 there is shown a fish unloading system for a fishing vessel wherein such vessel is constructed with a plurality of longitudinally adjacent fish holds. The athwartships walls separating such holds are provided with hatches through which the fish are moved longitudinally from hold to hold to a fish-elevating conveyor for removal from the vessel. The 4,103,792 system was directed particularly to the then-existing hold construction and suffers the short-coming of requiring the time-consuming steps of transferring the fish sequentially from hold to hold. This transfer from hold to hold is difficult, particularly since the hatches are elevated from the bottom of the hold necessitating the fish be raised off the bottom in order to pass through the hatches. Thus, there exists a need for a fish hold construction incorporating side apertures for transfer of fish athwartship to a central fish alley extending longitudinally of the vessel and common to all such fish hold apertures. The fish hold construction of my present invention satisfies such need.

SUMMARY OF THE INVENTION

It is a major object of the present invention to provide a fish hold construction for a fishing vessel which permits rapid, yet controlled, unloading of the fish.

A more particular object of the present invention is to provide a fish hold construction of the aforedescribed nature wherein the vessel is provided with a longitudinally extending fish alley which receives fish from longitudinally spaced fish holds, with such fish being moved from the fish alley into the intake of a fish elevating conveyor by continuous water or brine circulation through the fish alley. The use of water or brine as a conveying means inhibits bruising or other damage to the fish thereby maintaining the quality of the fish.

A major object of the present invention is to provide a fish hold construction of the aforedescribed nature wherein the fish are forced out of the fish holds into the fish alley either by means of water or brine pumped into such holds or by the release of brine which has been pumped into such holds.

Another object of the present invention is to provide a fish hold construction of the aforedescribed nature, wherein a pump is arranged with its suction in communication with the intake of the fish elevating conveyor to positively attract fish into such intake.

An additional object of the present invention is to provide a fish hold construction of the immediately aforedescribed nature, wherein the pump is utilized to effect water circulator through the fish alley.

Yet a further object of the present invention is to provide a fish hold construction of the aforedescribed nature which may be easily maintained in a sanitary condition.

It is an additional object of the present invention to provide a fish hold construction of the aforedescribed nature which permits a rapid, yet completely controlled, removal of the fish from the vessel utilizing a minimum number of workmen.

Other objects and advantages of the present invention will become apparent from the following detailed description.

BRIEF DESCRIPTION OF THE DRAWINGS

FIG. 6 is a vertical sectional view taken in enlarged scale along line 6—6 of FIG. 5;

DESCRIPTION OF PREFERRED EMBODIMENTS

Figure 1:
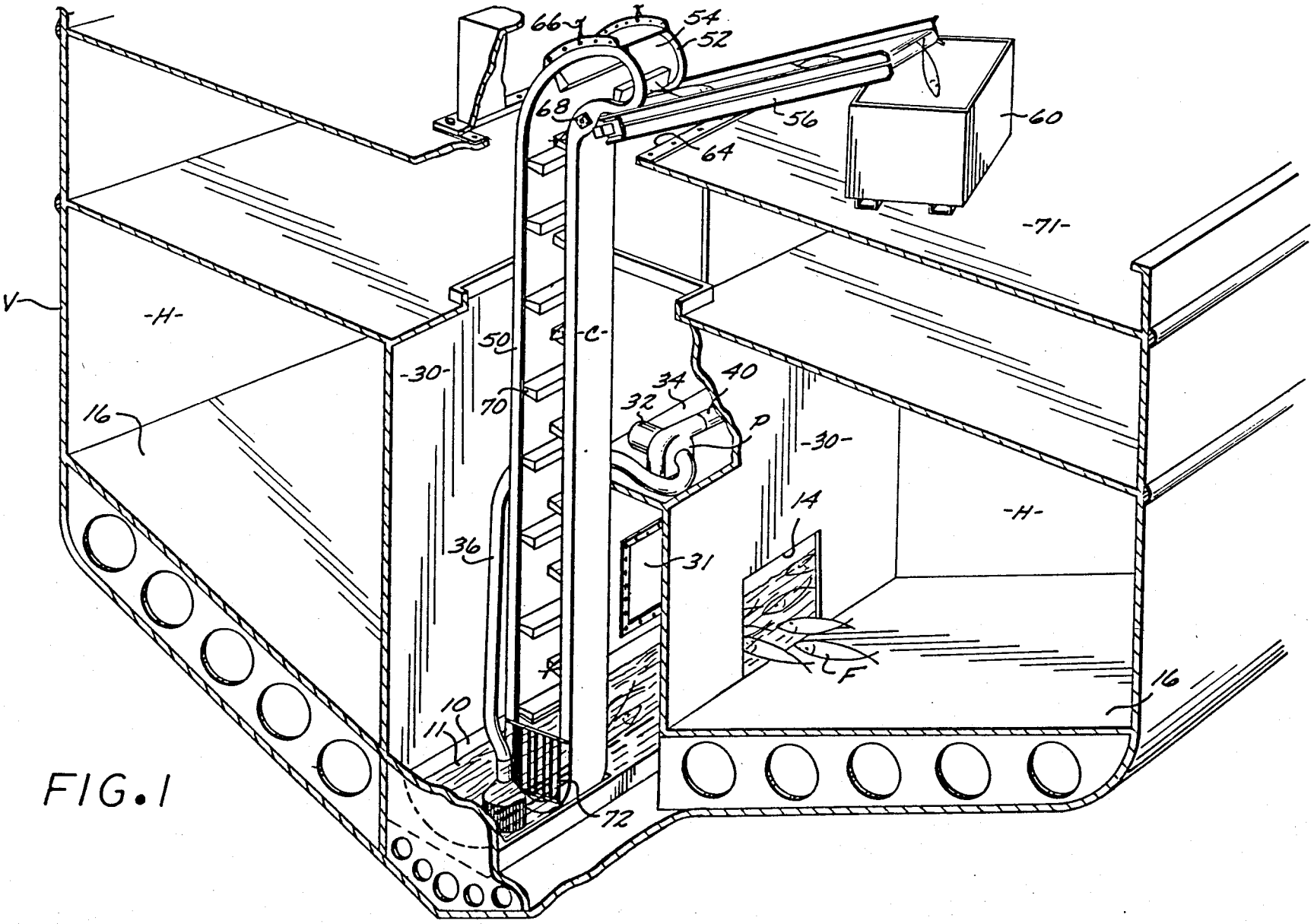
FIG. 1 is a perspective view of a preferred form of fish hold construction embodying the present invention.

Referring to the drawings, there is shown a fishing vessel V provided with a preferred form of fish hold construction embodying the present invention. Such fish hold construction preferably utilizes a self-feeding fish elevating conveyor C of the type shown in my U.S. Pat. No. 3,775,890. The vessel V is provided with a fish alley, generally designated 10, which extends longitudinally along the center line of such vessel. Vessel V is also provided with a plurality of fish holds H, each having one or more fish discharge hatches or apertures 14. The lower walls 16 of the fish holds H are preferably inclined downwardly and inwardly, whereby fish F stored in such compartments will slide through the apertures 14 under the influence of gravity and into the fish alley 10. Water or brine 11 is continuously circulated through the fish alley towards the intake of the fish elevating conveyor C whereby such fish will be raised by the conveyor C out of the confines of vessel V.

More particularly, vessel V has a bow 16 and a stern 18. Propulsion machinery (not shown) is disposed in the aft section 20 of the vessel. It will be observed that the vessel is provided with a first row of adjacent, longitudinally aligned fish holds H along its port side, and a second row of fish holds H along its starboard side. Such fish holds will preferably take the form of brine tanks. The fish alley 10 is disposed between the two rows of fish holds H along the center-line of the vessel, with the upper level of such alley generally corresponding to the lower elevation of the fish holds. Referring particularly to FIG. 1, fish stored in such holds will tend to slide towards the fish alley under the influence of gravity. The fish holds also include a vertically extending inner wall 30 adjacent the side of the alley 10 through which the fish fall into the alley. The aforementioned apertures 14 are normally closed by a suitable gate 31 which may consist of a flat plate bolted onto wall 30.

Water or brine is continually circulated from the forward end of alley 10 towards the aft end thereof by means of a conventional pump P. Such pump P will preferably be of the centrifugal type driven by a suitable hydraulic or electric motor 32. The pump P is positioned within a 'tween deck 34 above the alley 10. The intake of the pump is connected to a flexible suction conduit 36. The end of such conduit remote from the pump P is connected to an apertured water collection manifold 38 arranged on the downstream side of the conveyor C. The discharge of pump P is connected to a flexible discharge conduit 40. Such discharge conduit 40, extends forwardly along 'tween deck 34 and then downwardly into the forward end of alley 10.

The fish alley 10 extends longitudinally along the center-line of vessel V at he lower portion thereof. Alley 10 is defined by the vertical inner wall 30 and a horizontal wall 41 a fixed between walls 30 at their lower portions. Preferably, a body of cement 42 or the like is disposed above wall 41 to define a smooth concave surface 43 over which fish may be moved. The cement 42 adds ballast at the lower center-line of vessel V and also eliminates the sharp corners between walls 30 and 41 to thereby reduce the possibility of fish damage. Additionally, the use of cement 42 assists in maintaining cleanliness of the fish alley 10 by eliminating the possibility of foreign matter accumulating in sharp corners or cavities.

The preferred form of fish elevating conveyor C, shown in the drawings, includes an open sided enclosure, generally designated 50, that defines an elongated loop, that merges into a laterally offset upper portion 52. The latter is open as indicated at 54 to discharge fish onto the lower end of a power-driven fish unloading chute or conveyor 56. Chute 56 may be of the type shown in my U.S. Pat. No. 4,081,075. Conveyor C drops fish into a suitable container 60, or the like for removal from vessel V.

The upper end of fish elevating conveyor C is shown extending through main deck hatch 64. Such conveyor may be vertically adjustably supported by a bridle 66 connected to suitable hoisting apparatus (not shown). The conveyor C includes a pair of chains (not shown), which are looped about the interior of the enclosure 50. Such chains are driven by a conventional hydraulic drive motor secured at 68 to the upper portion of the enclosure. The chains are drivingly connected to a plurality of blades or baskets 70 of like construction, whereby such blades or baskets will undergo continuous linear movement about a closed path defined by the inner walls of the enclosure 50. In this manner the blades or baskets raise fish out of alley 10 to a fish discharging point on the main deck 71. It should be noted that a grill 72 is secured to the lower portion of enclosure 50 on the downstream side thereof. Such grill restrains fish from entering the manifold 38 after such fish are directed into the intake 74 of the conveyor.

In the operation of the aforedescribed fish hold construction, the fish holds H will be loaded in a normal fashion during fishing operations through suitable fish loading hatches (not shown). If desired, the fish upon species and/or size according to a manifest prepared by a fish cannery. The fish will be maintained refrigerated in a normal fashion until the vessel returns to port. When the vessel V is to be unloaded, pump P will be operated so as to constantly recirculate a body of water or brine 11 from the bow end of the alley 10 towards the stern portion thereof. The fish elevating conveyor C will be positioned as shown in the drawings and the blades or baskets thereof will be power-operated to move about a closed path defined by the inner walls of the enclosure 50. The gates 31 will then be opened so as to permit fish F to slide downwardly over the bottom walls 16 of the fish holds H through the apertures 14 under the influence of gravity and into the alley 10. It should be particularly noted that movement of the fish into and through the alley 10 is cushioned by the water moving therethrough. Such cushioning effect of the water also takes place as the fish move into the intake 74 of the conveyor C. Movement of the fish into the conveyor intake is enhanced by the positioning of manifold 38 directly adjacent the downstream end of such intake. It should also be noted that the water flowing through alley 10 serves to provide an initial cleaning effect for the fish. In this regard, such water may be periodically replaced during a fish unloading operation.

Preferably, the forward fish holds will be unloaded first so that the alley 10 will slope aft. This will enhance the circulatory flow of water through the alley. It may also be desirable to incline the alley downwardly from the bow towards the stern of the vessel V, for the same purpose. It should also be noted that the volume of fish entering the alley may be controlled by selective opening of gates 31. Moreover, if the fish holds have been selectively loaded according to the species and size of the fish, as such fish are brought on board, a desired species and/or size of fish may be unloaded independently of the other fish. Should some of the fish fail to automatically slide downwardly out of the fish holds, workmen may manually slide the fish through the open apertures 14. The fish brought to the main deck 71 of the fishing vessel may be off-loaded in a conventional manner by means of lifting buckets, chutes or the like.

It is a particular advantage of the fish hold construction of the present invention that the alley 10 is easily maintained in a sanitary condition. Thus, after the completion of a fish unloading operation, it is only necessary to apply a high-pressure water spray and/or steam to the fish alley so as to clean such alley. The sanitation of the fish alley may be enhanced by applying an appropriate smooth material, such as fiberglass, over the surfaces thereof.

Figure 5:
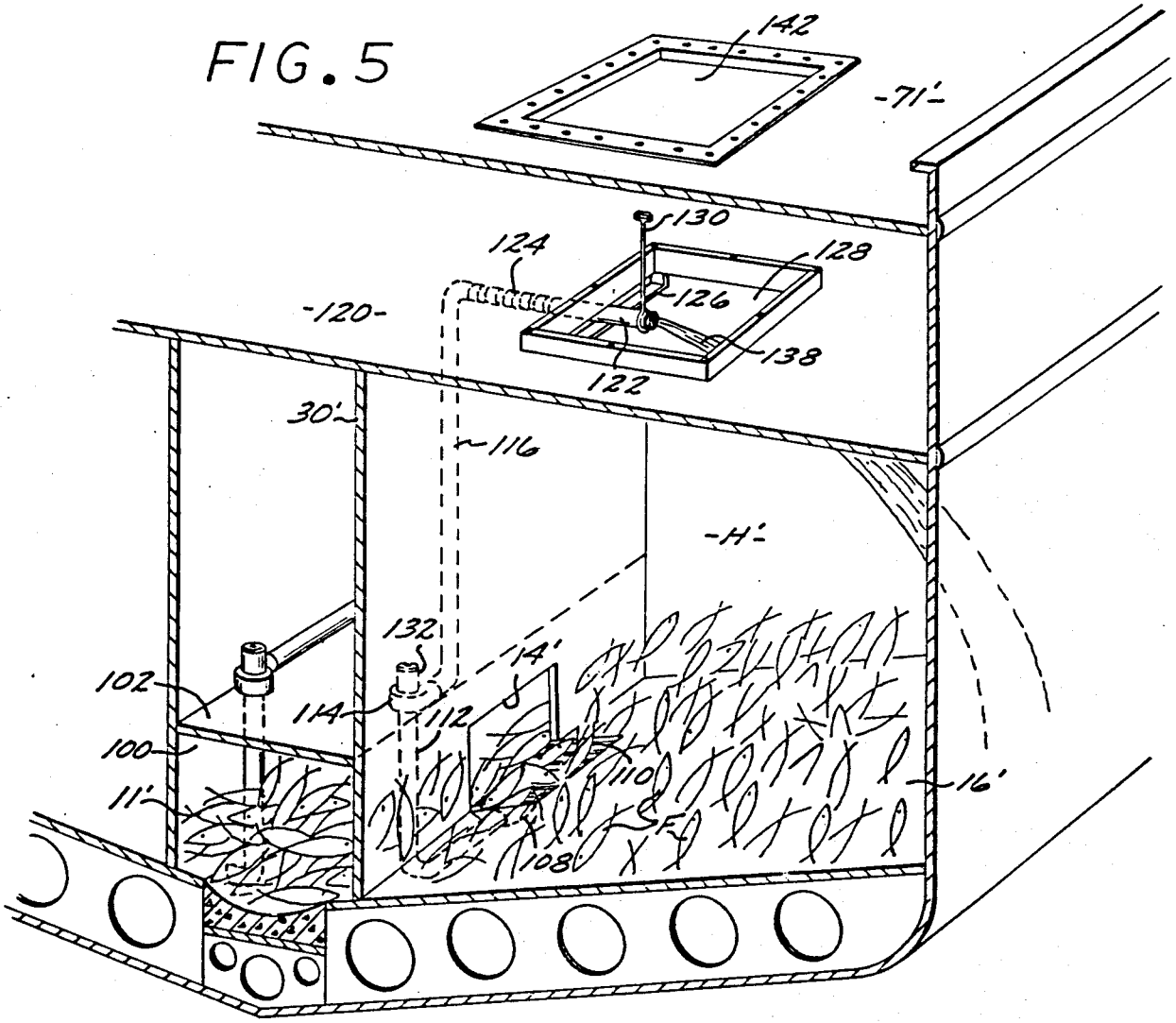
FIG. 5 is a fragmentary perspective view taken along line 5—5 of FIG. 4.
Figure 4:
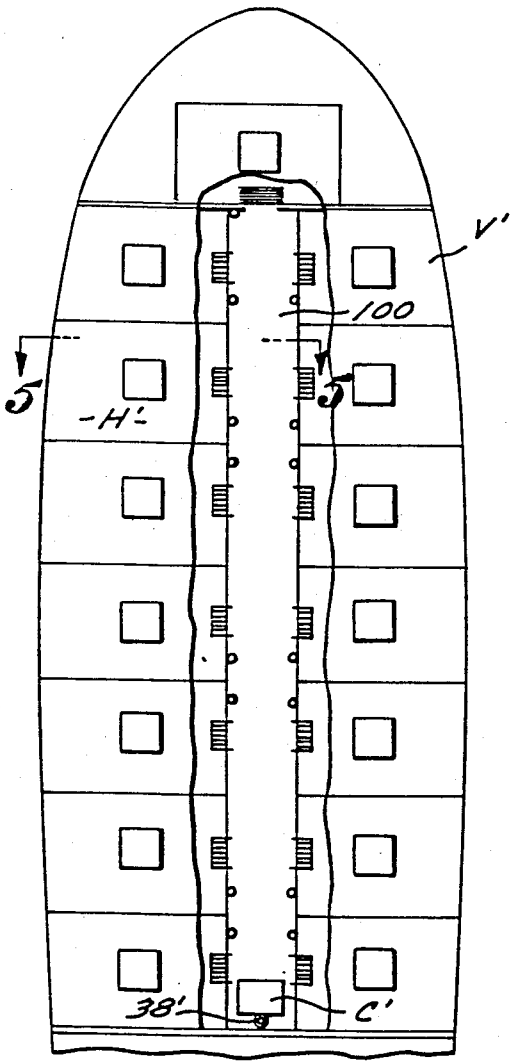
FIG. 4 is a top plan view of a fishing vessel provided with a second form of fish hold construction embodying the present invention.

Referring now to FIGS. 4, 5 and 6, there is shown a fishing vessel V' provided with a second form of fish hold construction embodying the present invention. The system of FIGS. 4, 5 and 6 preferably utilizes two self-feeding fish elevating conveyor of the type described hereinbefore CB located near the bow of vessel V' and CS located towards the stern of vessel V . As shown particularly in FIG. 5, the upper portion of fish alley 100 is provided with a 'tween deck 102, with the space above such 'tween deck being available to house equipment such as pumps, pipes and refrigeration components. This arrangement keeps the fish alley 100 uncluttered and deck 102 restrains foreign matter from entering the fish alley.

Figure 3:
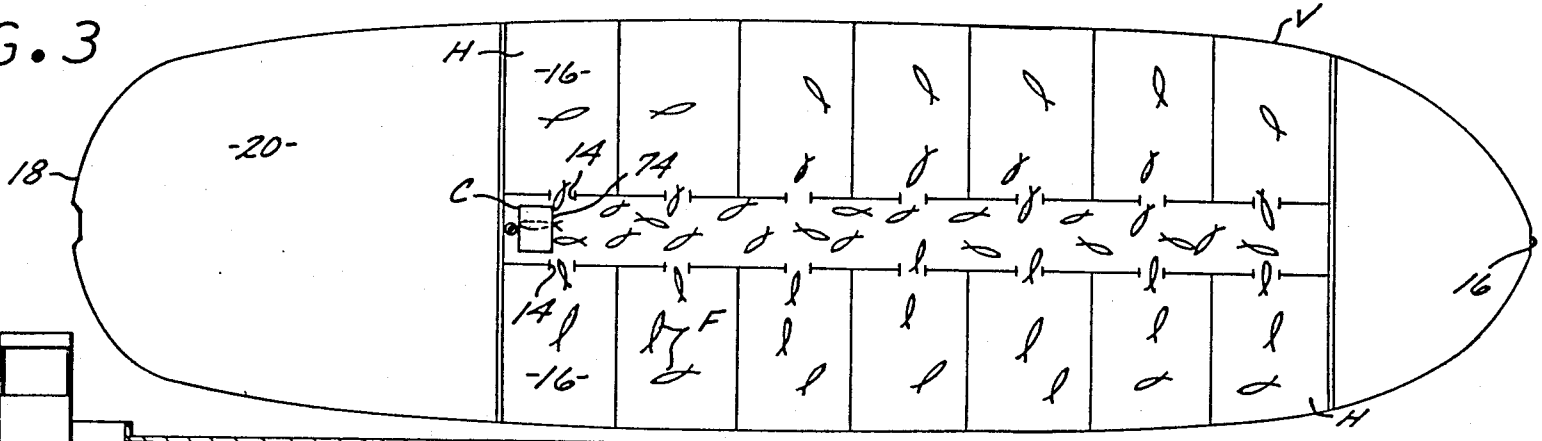
FIG. 3 is a reduced top plan view of a fishing vessel provided with the preferred form of fish hold construction embodying the present invention.
Figure 2:
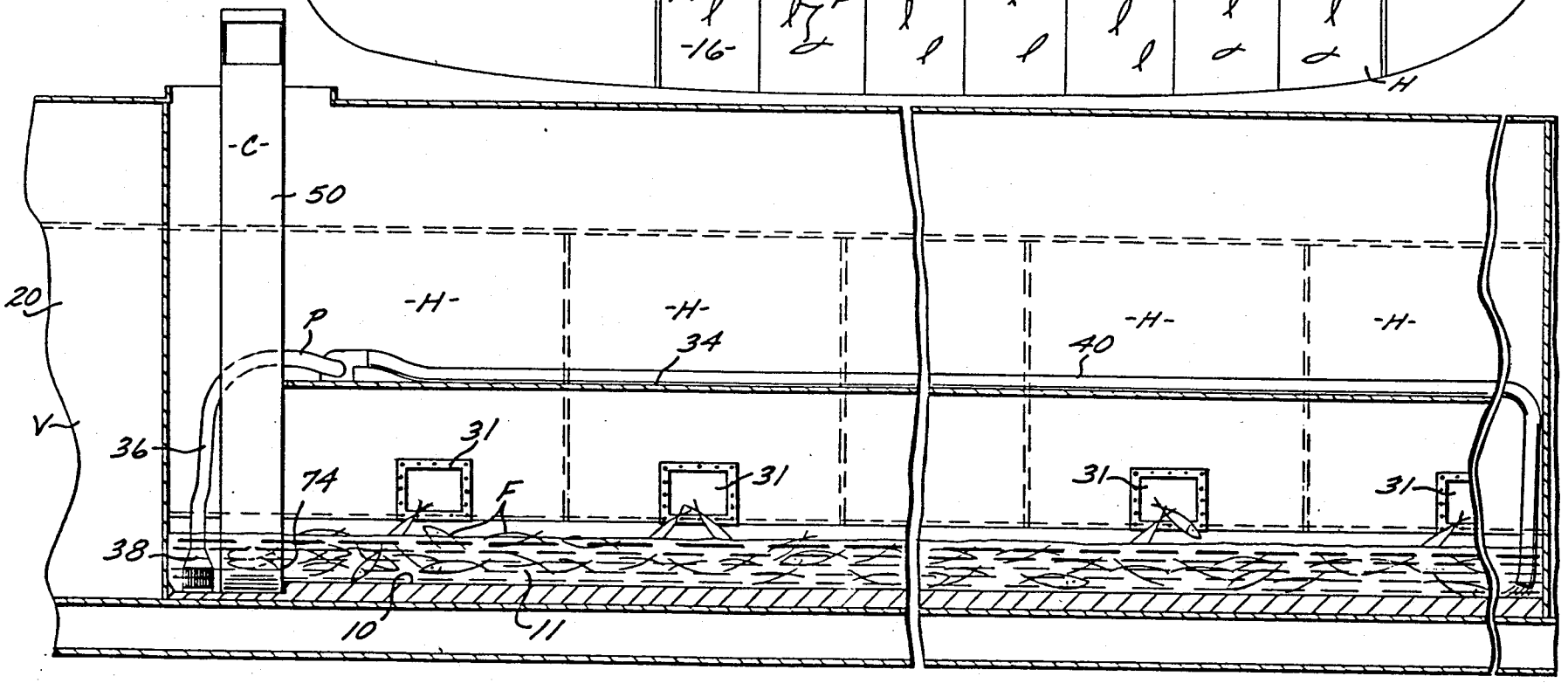
FIG. 2 is a broken side elevational view taken partly in section showing such fish hold construction.

FIG. 5 discloses the arrangement of a modified fish hold H'. Such fish hold has a fish aperture 14' in communication with fish alley 100, similar to hatch 14 described hereinbefore. It should be understood that prior to a fish unloading operation such hatch 14' is closed by a gate (not shown), such as is designated 31 in FIG. 2. The lower walls 16' of fish hold H are shown inclined downwardly and inwardly whereby fish F stored in such hold will slide through the aperture 14 under the influence of gravity and into the fish alley 100. It should be understood, however, that such lower walls 16' may also be horizontal rather than inclined. It should likewise be understood that water or brine 11' is continuously circulated through the fish flume alley towards the intake of the fish elevating conveyors whereby such fish may be raised by the conveyors CB and CS out of the confines of the vessel V', in a manner similar to that described hereinbefore with respect to FIGS. 1, 2 and 3. The flow of fish out of the holds and into the fish alley 100 is assisted by water or brine directed into the holds in a manner described hereinafter.

It should be noted, however, that control over which direction the fish move within fish alley 100 may be achieved by means of a centrifugal pump 103 disposed within 'tween deck 102 intermediate the length of the fish alley 10 in a manner to be described hereinafter. The inner portion of wall 16' adjacent hatch 14' is provided with a sump 108 contiguous with the lower edge of hatch 14' and covered by a grill 110. Sump 108 is connected to a pipe 112', with the end opposite such sump of pipe 112 being connected to the intake of a conventional centrifugal pump 114 The discharge of pump 114 is connected to an upwardly extending pipe 116 that is secured to the inboard surface of the vertically extending inner wall 30' adjacent one side of fish flume aley 100. The upper end of pipe 116 extends upwardly through a sub-deck 120 and is connected to a nozzle 122. A flexible section 124 is interposed between the upper end of pipe 116 and nozzle 122. Nozzle 122 is slidingly supported by a strap 126 that depends from the inboard side of a hatch 128. Nozzle 122 is attached to a handle 130 that extends upwardly through hatch 128. With this arrangement, the nozzle 122 may be manipulated along the length of strap 126.

Upon operation of pump 114 by an electric motor 132 coupled thereto, water or brine will be drawn from sump 108 into the pump, with such water then being forced through nozzle 122 as indicated at 138. Such water is utilized to assist the flow of fish F from hold H' downwardly along the lower walls 16 through hatch 14'. Manipulating handle 130 is employed to control the direction of water being discharged through nozzle 122 so as to cover the space encompassed within hatch H'. The provision of the sump 110 adjacent hold 14' serve to assist in drawing the fish downwardly through such hold. An access hatch 142 may be provided in main deck 71'. The usual water or brine level in hatch 14' and fish alley 100 is designated 143 in FIG. 5. The combination of water flow through fish alley 100 and water flow from apertures 14' into the fish alley may be likened to the flow of water into a river from the river's tributaries.

It should be understood that the aforedescribed arrangement of hold H' and its components will be utilized in each of the holds of vessel V'.

Fish moving into fish alley 100 through hatches 14 are urged toward one or both of the bow and stern conveyors CB and CS by flow of water within such fish alley. The direction and volume of water flow in the fish alley is controllable by water delivered by the aforementioned centrifugal pump 103. As shown in FIGS. 4 and 6, such pump is driven by an electric motor 146, and has its intake connected by T-fitting 148 to a forwardly extending pipe 150 and a rearwardly extending pipe 152 that extend along 'tween deck 102. Shut-off valves 154 and 156, respectively, are interposed in such piping so as to control the magnitude of water volume being drawn into the pump's intake. The opposite ends of pipes 154 and 156 are connected to forward and aft apertured water collection manifolds 158 and 160, respectively, positioned within the front and rear portion of fish alley 100. The discharge of pump 103 is connected to one end of a pair of hoses 161 and 162. The opposite end of hoses 161 and 162 may be selectively manually directed to any part of fish alley 103 by means of apertures (not shown) formed in deck 102, or to a storage tank (not shown).

The aforedescribed arrangements permit flexibility with respect to the direction of water (and thus fish) flow within fish alley 100. If fish are to be concurrently unloaded by both the bow and stern conveyors CB and CS, valves 154 and 156 will be in an open position and the free end of hose will be arranged to direct the discharge of pump 103 into the intermediate part of fish alley 100. Water and fish will then move from the intermediate part of the fish alley towards conveyors CB and CS. If it is desired to unload fish solely by the bow conveyor CB, aft valve 156 will be closed and the free end of hose 162 will be positioned toward the aft portion of fish alley 100. Conversely, if fish are to be unloaded from the aft conveyor CS, valve 155 will be closed and the free end of hose 162 will be positioned toward the bow of fish alley 100. The choice of direction of water and fish flow may be dictated under some conditions of boat loading when the vessel is either bow or stern heavy. The water level 143 in fish alley 100 may conveniently be controlled by the point of discharge from hose 162, i.e. to lower such water level the hose may temporarily discharge into a storage tank (not shown)

Figure 7:
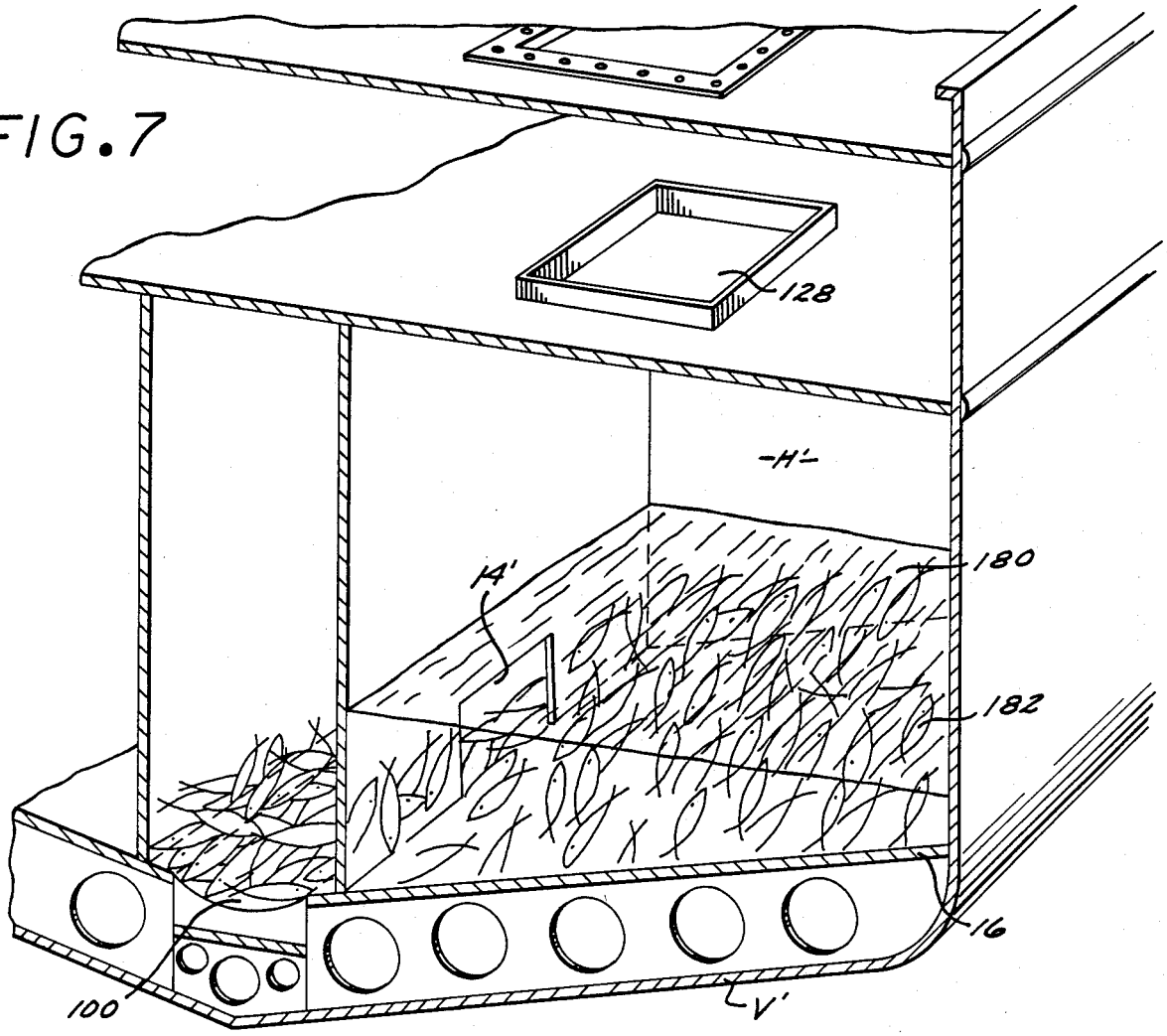
FIG. 7 is a fragmentary view similar to FIG. 5 but showing fish being removed from a fish hold by releasing brine that has been pumped into such fish hold.
Figure 8:
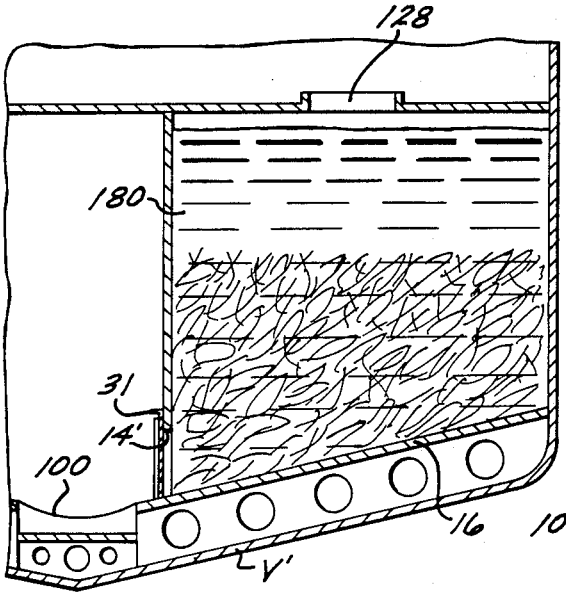
FIGS. 8 and 9 are athwartship fragmentary views showing the fish removal operation depicted in FIG. 7.
Figure 9:
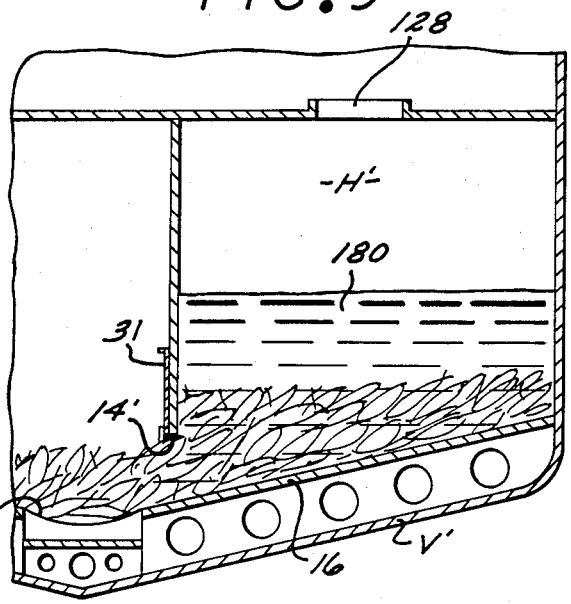

Referring now to FIGS. 7, 8 and 9, there is shown another arrangement for removing fish from the type of fish hold H' shown in FIG. 5 into the fish alley 100. This arrangement utilizes the flushing effect of a body of brine 180 which is built up in the hold H' by the fishing vessel's conventional built-in brine circulating pumps (not shown). Such brine pumps may be utilized to fill each of the vessel's holds with a brine solution before the fish are loaded into such holds. After the hold H' has been loaded with fish 182, the brine pumps will circulate brine through the hold so as to refrigerate such fish. Generally, when the fish are being loaded, the hold is filled to a maximum of approximately three-quarters volume. As the fish are loaded into the hold through hatch 128, the brine will overflow in a conventional manner. The fish may be loaded into the hold from a deckhopper (not shown) by fish flumes (not shown) to designated holds with respect to the size and species of such fish. The brine serves to cushion the fall of the fish as they drop into the holds.

After the fishing vessel is loaded with fish, it will travel to a fish processing plant for unloading. During such travel, the brine circulating pumps will handle the refrigeration of the fish in the holds. At this time, the holds will preferably be maintained full of brine. When the fish unloading operation is to begin, the level of the brine will be maintained in the upper portion of the hold, as indicated in FIG. 8. Also as indicated in FIG. 8, the gate 31 of hold H' will be in its closed position. To readily remove the fish from the hold H' into the fish alley 100, gate 31 is raised and the fish 182 within hold H' will be flushed into the fish alley 100 by the brine 180 as it flows through the hatch 14' into the fish alley. This movement of the fish is facilitated .by their brine-induced buoyancy. Fish will be removed from the fish alley 100 in the manner described hereinbefore. During the unloading of the fish 182 from the holds, the brine circulating pumps will maintain the brine at a desirable level so as to ensure that the fish will continue flowing from the hold into the fish alley and thence into the fish elevating conveyor means.

It will be apparent from the foregoing description that a fish hold construction embodying the present invention is less liable to bruise or otherwise damage the fish than is true with existing systems. A fish unloading system embodying the present invention permits the fish to be economically unloaded in an orderly fashion without any delay. This feature is made possible by use of the fish alley. The cost of the vessel, as well as its cargo carrying capacity, is likewise directly affected by the use of such fish alley in conjunction with utilization of the 'tween deck 102 for housing piping, pumps and refrigeration equipment. Finally, the components utilized in a fish unloading system of the present invention may be readily maintained in a sanitary condition. In this regard, note, fish alley 100 is provided with a cement liner 42 defining a smooth, concave surface 43'.

Various modifications and changes may be made with respect to the foregoing detailed description without departing from the spirit of the present invention.

I claim:

1. A fish hold construction for a fishing vessel, said construction system comprising:

a fish alley extending longitudinally along the center line of said vessel at a lower portion thereof;

a plurality of fish storage holds disposed along the length of said vessel above said fish alley and on opposite sides thereof, said holds each having a vertically extending inner wall adjacent said fish alley and a lower wall that is inclined downwardly and inwardly whereby fish stored in said fish hold will slide along said lower wall towards said fish alley, with the help of gravity;

a fish discharge aperture formed in the lower portion of each of said inner walls;

selectively openable gate means for said fish discharge apertures to normally retain fish within said holds, with said fish falling through said discharge apertures into said fish alley when said gate means are opened;

flushing means for urging fish out of said holds through said gates and into said fish alley when said gates are opened;

a power-operated fish elevating conveyor having an intake positioned within said fish alley and a discharge positioned above said alley; and means for continuously circulating liquid through said fish alley from one end thereof towards the intake of said fish elevating conveyor to thereby direct fish falling into said fish alley from said storage holds into the intake of said fish elevating conveyor.

2. A fish hold construction as set forth in claim 1 which includes:

a body of cement disposed in said fish alley to define a smooth concave surface over which fish are moved along said alley, with said cement also adding ballast at the lower center-line of the vessel.

3. A fish hold construction as set forth in claim 1, wherein the means for circulating liquid through said fish alley includes a pump having its suction connected to a point in said fish alley downstream of the intake of the fish elevating conveyor and said pump having its discharge connected to the end of said alley upstream of the fish elevating conveyor.

4. A fish hold construction as set forth in claim 1, wherein the fish elevating conveyor includes a plurality of continuously linearly moving fish-impelling surfaces which follow an endless path extending between the fish alley and a fish discharging point on the fishing vessel.

5. A fish hold construction as set forth in claim 1 wherein said flushing means includes a pump that urges said liquid through nozzle means onto the fish in each said hold.

6. A fish hold construction as set forth in claim 1 which further includes a 'tween deck above said fish alley to restrain foreign matter from entering the fish alley and with the space above the 'tween deck being available to house equipment.

7. A fish hold construction as set forth in claim 1 wherein said flushing means includes a body of brine that is built up within said holds before said gates are opened.

8. A fish hold system as set forth in claim 5 wherein said nozzle means are manipulable from the upper portion of each hold.

9. A fish hold system as set forth in claim 7 wherein said brine is recirculated through each said hold as said fish are being removed therefrom.

10. A fish hold construction for a fishing vessel, said construction comprising:

a fish alley extending longitudinally along the center line of said vessel at a lower portion thereof;

a plurality of fish storage holds disposed along the length of said vessel above said fish alley and on opposite sides thereof, said holds each having a vertically extending inner wall adjacent said fish alley and a lower wall that is inclined downwardly and inwardly whereby fish stored in said hold will slide along said lower wall towards said fish alley, with the help of gravity;

a fish discharge aperture formed in the lower portion of each of said inner walls;

gate means for said fish discharge apertures to normally retain fish within said holds, with said fish falling through said discharge apertures into said fish alley when said gate means are opened;

a power-operated fish elevating conveyor having an intake positioned within said fish alley and a discharge positioned above said alley;

means for continuously circulating water through said fish alley from one end thereof towards the intake of said fish elevating conveyor to thereby direct fish falling into said fish alley from said storage holds into the intake of said fish elevating conveyor; and said gate means being selectively openable to control the species or size of the fish being unloaded.

* * * * *